United States Patent [19]

Schelle et al.

[11] 4,102,459

[45] Jul. 25, 1978

[54] ADAPTOR DEVICE FOR COUPLING RAILWAY VEHICLES HAVING DIFFERENT TYPES OF COUPLERS

[75] Inventors: Axel Schelle, Rottach-Scherfen; Kuno Nell, Zorneding, both of Fed. Rep. of Germany

[73] Assignee: Knorr-Bremse GmbH, Munich, Fed. Rep. of Germany

[21] Appl. No.: 817,450

[22] Filed: Jul. 20, 1977

[30] Foreign Application Priority Data

Jul. 20, 1976 [DE] Fed. Rep. of Germany ..... 2632571

[51] Int. Cl.[2] ..... B61G 3/00

[52] U.S. Cl. ..... 213/112; 213/75 R

[58] Field of Search ..... 213/75 R, 77, 100 R, 213/100 W, 109, 112, 111, 152, 110

[56] References Cited

U.S. PATENT DOCUMENTS

| | | | |
|---|---|---|---|
| 1,407,939 | 2/1922 | Geiger | 213/112 |
| 1,647,486 | 11/1927 | Trimming | 213/100 R |
| 2,490,453 | 12/1949 | Metzger | 213/111 |
| 2,923,419 | 2/1960 | Kayler | 213/110 |

*Primary Examiner*—Trygve M. Blix
*Assistant Examiner*—Jesus D. Sotele
*Attorney, Agent, or Firm*—Edmund M. Jaskiewicz

[57] ABSTRACT

An adaptor device for the coupling of Janney and Willison couplers on railway vehicles has a body portion one side of which has a rigid configuration conforming to the configuration of a Janney coupler in the locked position and the other opposed side having a rigid configuration conforming to the configuration of a Willison coupler in the locked position. The device may also be provided with stop structures for limiting the vertical movement of the adaptor device with respect to both the Willison and Janney couplers.

5 Claims, 4 Drawing Figures

ADAPTOR DEVICE FOR COUPLING RAILWAY VEHICLES HAVING DIFFERENT TYPES OF COUPLERS

The present invention relates to a device for coupling railway vehicles, more particularly, to an adaptor device for coupling Willison and Janney couplers of railway vehicles.

In order to facilitate rail transportation efforts have been made to standardize many components of railway vehicles utilized by railroads in different countries of the world. One such example of standardization is that a uniform rigid pull-thrust coupling is now in use virtually throughout all of Europe. This coupling designated as a Willison coupling which is of the central buffer-type and is automatic in operation. A further advantage of the Willison coupler is that it can be coupled directly to the automatic coupler commonly used on the State Railroads of the USSR and designated as coupling SA-3.

Other countries, such as the United States and Japan, have used for many years automatic couplers known as Janney-type couplers. The continuing growth in international trade has resulted in increased use of rail transportation between countries using Willison and Janney couplers. Thus, problems have arisen with respect to coupling railway vehicles equipped with these different couplers.

In order to connect automatic couplers with the screw couplers which have been generally used up until the present time on railway vehicles throughout most of Europe, a hook has been provided in the center of the coupler head or laterally of the coupler head such that a link of the screw coupler on another vehicle can be positioned over the hook. It has also been proposed to mount the head of the automatic coupler in such a manner that the coupler head can be moved laterally or downwardly in order to expose a standard draw-hook to which a link of the screw coupler can be connected. However, the moving away of the head of the automatic coupler can be carried out only with certain structures of drawcouplers. Other proposals include modifying the screw coupler in such a manner that the coupler itself or a suitable intermediate element is introduced into the mouth of the automatic coupler and retained securely in position by its coupling mechanism.

There has also been proposed a form of a transition or adaptor coupling between an automatic coupler and a screw coupler. Such a transition member comprised a rigid intermediate element having horizontal guide surfaces which engaged the mouth of the automatic coupler and upon which a half of a conventional screw coupler was attached by means of a shackle. However, this transition coupler cannot be used to connect a Willison coupler to a Janney coupler.

It is therefore the principal object of the present invention to provide a novel and improved adaptor device for coupling together a Willison-type coupler to a Janney-type coupler on railway vehicles.

It is a further object of the present invention to provide such an adaptor device which is compact in size, relatively light in weight, reliably transmits pull and thrust between couplers and does not limit in any way the space required for operation of the coupler.

According to one aspect of the present invention an adaptor device for coupling of Janney and Willison couplers on railway vehicles may comprise a body portion having two opposed sides. The sides have rigid configurations conforming respectively to the configurations of Janney and Willison couplers in their locked positions.

The body portion can also be provided with structure for vertically positioning the adaptor device with respect to such couplers.

The adaptor device can be suspended into the operating end of the Willison coupler where it will be held firmly in position by the movable part of the coupler. To couple with a Janney coupler the movable knuckle of the Janney coupler will lockingly engage a correspondingly shaped projection on the adaptor device and will be locked in this position by means of the latch pin.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
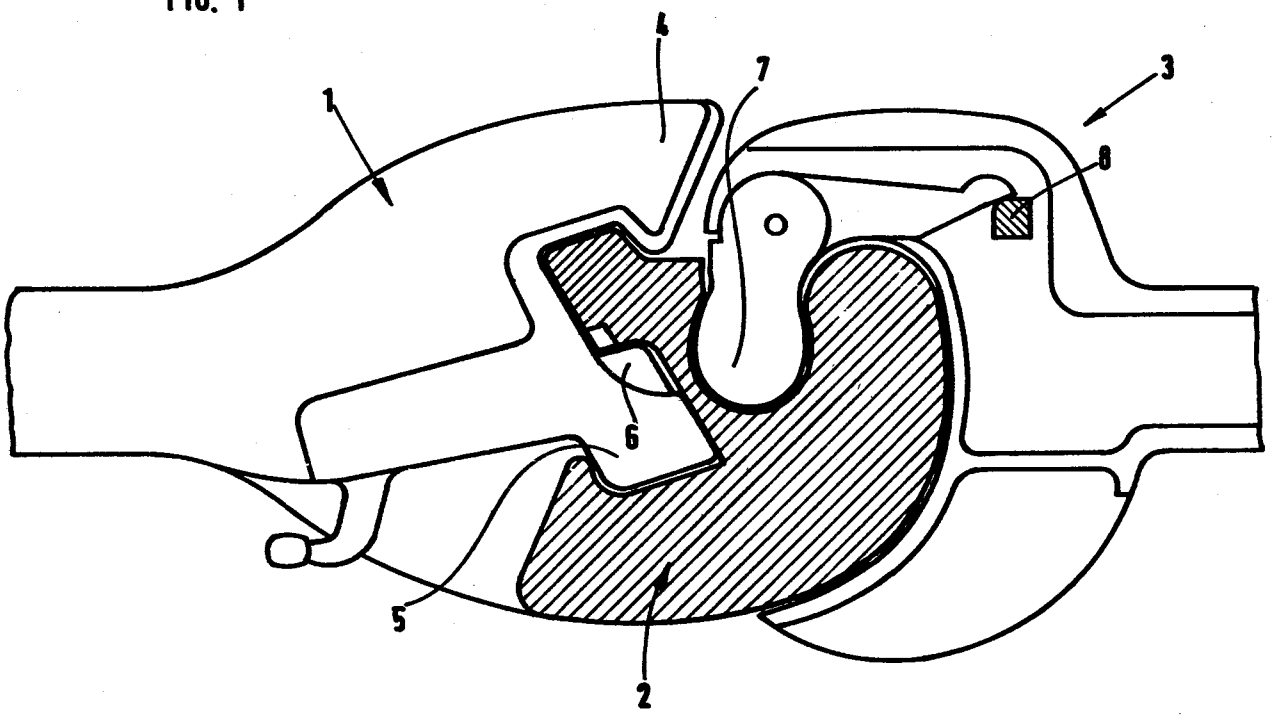
FIG. 1 is top plan view of coupled Willison and Janney couplers utilizing the adaptor device of the present invention.
Figure 2:
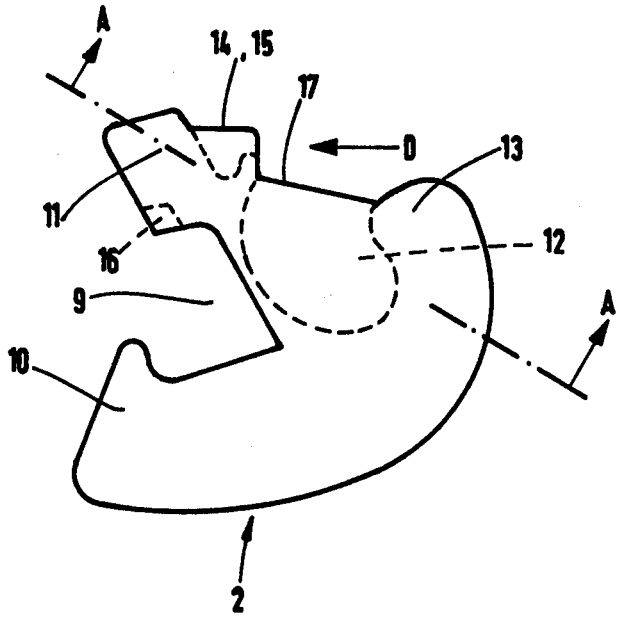
FIG. 2 is a top plan view of the adaptor device shown in FIG. 1.
Figure 3:
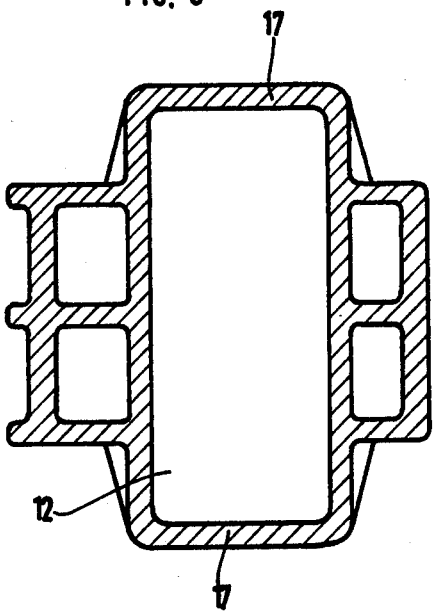
FIG. 3 is a sectional view taken along the line A—A of FIG. 2.

In FIG. 1 there is shown a coupling head 1 of a Willison coupler coupled by means of an adaptor device or intermediate element 2 to a coupling head 3 of a Janney coupler. The Willison automatic central buffer coupler comprises two fixed jaws 4 and 5 that enclose a mouth within which is displaceably mounted a locking wedge 6. When two Willison couplers are coupled together so as to be in a mirror inverted relationship, the locking wedges 6 are initially shifted when the coupling heads engage until the wedges become free as a result of lateral movement of the heads a short distance in front of the end or coupled position. The free wedges 6 will then drop forwardly under their own weight and will wedge the Willison coupling heads with respect to each other. When the Willison couplers are to be uncoupled, a wedge must be pulled back by the operating device as known in the art. The coupling heads are thus unlocked and move apart when the respective vehicles are moved with respect to each other.

The Janney-type automatic coupler comprises a knuckle or jaw 7 in its coupling head which is pivotably mounted about a vertically extending knuckle pin. The knuckle 7 is shown in its locked or coupled position in FIG. 1. The coupler is ready for coupling when the knuckle is pivoted so as to extend outwardly from the coupling head 3.

When two Janney-type coupling heads engage, each knuckle 7 will be pivoted into its closed position as shown in FIG. 1 under the action resulting from contact with the other coupling head. As the knuckle 7 is pivoted into its locked position a latch 8 will drop downwardly to lock the knuckle in position. In order to uncouple the Janney couplers the knuckle is unlocked by lifting the latch 8 in a manner known in the art. The latch 8 is lifted when the Janney coupler is adapted for top operating conditions.

As the cars with the Janney couplers are separated, the knuckles are pivoted to their outwardly extending positions in which they are ready for a subsequent coupling operation. A coupling is not possible between Janney couplers when the knuckles are in the locked or coupled positions.

The adaptor device 2 of the present invention is positioned in the shaded area of FIG. 1 and has a body portion on one side of which is a mouth or opening 9 enclosed by spaced rigid jaws 10 and 11. On the other or opposite of the adaptor device body portion there is formed a mouth or opening 12 by means of a projection 13 protruding from the body portion. The side of the adaptor device having the mouth 9 thus has a rigid configuration which corresponds to the configuration of a Willison coupler in the locked or coupled position in which the wedges 6 are engaged. The side of the adaptor device having the mouth 12 has a configuration corresponding to the configuration of a Janney coupler in the locked or coupled position in which the knuckle 7 is locked.

Figure 4:
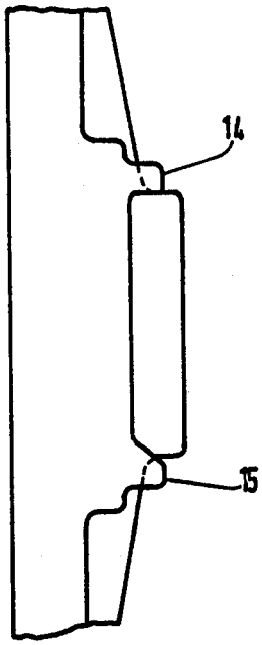
FIG. 4 is a partial elevational view of the adaptor device looking in the direction indicted by the arrow D of FIG. 2.

The vertical dimension or height of the adaptor device 2 is greater than the vertical extension of the frontal section of the wedge 6 in the Willison coupler 1. The knuckle 7 of the Janney coupler 3 can thus engage the mouth 12 at different levels or can be vertically displaced within the mouth 12. Vertically spaced horizontal projections 14 and 15 are formed on the body portion of the adaptor device 2. When the device 2 is suspended in the Willison coupler head 1 the projections 14 and 15 will engage vertically the jaw 4 of the coupler head and thus position vertically the adaptor device 2. The positioning of the projections 14 and 15 are best seen in FIG. 4.

The flank of jaw 11 of the adaptor device which is engaged by latch 6 of the Willison coupler 1 is provided with a recess 16 to facilitate suspension of the adaptor device with respect to the Willison coupler. The recess 16 has oblique guide surfaces by means of which the wedge 6 is urged rearwardly without tilting when the adaptor device 2 is suspended in the coupler head 1. The element or adaptor device 2 is held firmly on the coupler head 1 by means of the projections 14 and 15 and the engaged wedge 6 and thus can be automatically coupled to a Janney coupler 3 when a Janney coupler having an unlocked knuckle 7 is brought into engagement with the adaptor device 2 and the knuckle 7 penetrates into the mouth 12 of the adaptor device and is then locked in position by the latch 8 dropping downwardly. The configuration of projection 13 corresponds to the symmetrically arranged, in mirror relationship, locked knuckle 7 of a Janney coupler.

The mouth 12 of the device 2 is closed at its upper and lower ends by bridges 17. The bridges 17 not only provide for the transmission of forces or tractive efforts but at the same time function as vertical stops for the knuckle 7 of a coupled Janney coupler so that the knuckle is vertically displaceable in the mouth 12. A portion of the tractive effort is also transmitted through the rigid jaw 10 of the adaptor device. Thrust forces are transmitted through the reciprocally engaged relatively large surfaces of the adaptor device 2 and central buffer couplings to the configurations of the automatic couplers. The presence of the bridges thus avoids inadvertent uncoupling which might occur through excessive vertical displacement of the couplers with respect to each other.

As a modification, the bridges 17 may be positioned closer together so as to lock the adaptor device 2 on the Janney coupler head 3. Vertical displacement of the coupler heads 1 and 3 is then achieved by a sliding or vertical displacement of coupler jaw 5 in mouth 9 of the adaptor device. In this modification the projections 14 and 15 are unnecessary and may be omitted. The vertical locking of the adaptor device 2 on the Janney coupler head similarly permits the possibility of relative vertical displacement and enables differently loaded vehicles to be readily coupled.

The vertical displacement of the adaptor device 2 with respect to either the Willison or the Janney coupler thus makes it possible to readily couple railway vehicles which may be at different vertical heights because of different loads. This might occur when a loaded car is to be coupled to an unloaded car.

Thus it can be seen that the present invention has provided an adaptor device which is compact, relatively light in weight and which readily permits the coupling of Willison and Janney couplers.

It will be understood that this invention is susceptible to modification in order to adapt it to different usages and conditions, and accordingly, it is desired to comprehend such modifications within this invention as may fall within the scope of the appended claims.

What is claimed is:

1. An adaptor device for the coupling of Janney and Willison couplers on railway vehicles comprising a body portion having two opposed sides, said sides having rigid configurations conforming respectively to the configurations of Janney and Willison couplers in their locked positions, and means on said body portion for vertically positioning the adaptor device between such couplers in coupling position to provide for automatic engagement of the couplers.

2. An adaptor device as claimed in claim 1 wherein the side of the body portion having the Willison coupler configuration has a recess therein with oblique guide surfaces.

3. An adaptor device as claimed in claim 1 wherein the side of said body portion having the Willison coupler configuration has vertically spaced horizontal projections thereon to limit the vertical displacement of the device with respect to such coupler.

4. An adaptor device as claimed in claim 3 wherein the side of said body portion having the Janney coupler configuration has an opening therein to receive a knuckle of a Janney coupler, said opening having a vertical dimension greater than that of a Janney knuckle so that such a knuckle is capable of vertical movement within said opening.

5. An adaptor device as claimed in claim 4 and means closing the upper and lower ends of said opening for limiting the vertical movement of a Janney knuckle within said opening.

* * * * *